United States Patent [19]

Laufer

[11] 4,366,795

[45] Jan. 4, 1983

[54] FUEL INJECTION PUMP FOR INTERNAL COMBUSTION ENGINE

[75] Inventor: Helmut Laufer, Stuttgart, Fed. Rep. of Germany

[73] Assignee: Robert Bosch GmbH, Stuttgart, Fed. Rep. of Germany

[21] Appl. No.: 173,516

[22] Filed: Jul. 30, 1980

[30] Foreign Application Priority Data

Aug. 7, 1979 [DE] Fed. Rep. of Germany ..... 2931937

[51] Int. Cl.[3] ..... F02M 59/20

[52] U.S. Cl. ..... 123/502

[58] Field of Search ..... 123/502, 459, 506

[56] References Cited

U.S. PATENT DOCUMENTS

| | | | |
|---|---|---|---|
| 3,447,520 | 6/1969 | Drori | 123/502 |
| 3,552,366 | 1/1971 | Kemp | 123/502 |
| 3,910,724 | 10/1975 | Okamoto | 123/502 |
| 4,074,667 | 2/1978 | Skinner | 123/502 |
| 4,169,444 | 10/1979 | Kaibara et al. | 123/502 |
| 4,202,303 | 5/1980 | Mowbray | 123/502 |
| 4,228,773 | 10/1980 | Stumpp et al. | 123/459 |
| 4,273,090 | 6/1981 | Hofer et al. | 123/502 |

*Primary Examiner*—Ira S. Lazarus
*Assistant Examiner*—Magdalen Moy
*Attorney, Agent, or Firm*—Edwin E. Greigg

[57] ABSTRACT

A fuel injection pump having a hydraulic injection onset adjustment apparatus is proposed in which a supplementary variation of the injection onset is obtained by means of the variation of the pressure deviating from proportionality. The pressure control valve used has a throttle connection between the pressure chamber and the spring chamber. The variation of the pressure is obtained by means of controlling the discharge channel of the spring chamber, by means of a control slide exposed to the pump pressure, whose restoring spring is variable in accordance with engine characteristics.

4 Claims, 2 Drawing Figures

FUEL INJECTION PUMP FOR INTERNAL COMBUSTION ENGINE

BACKGROUND OF THE INVENTION

The invention relates to a fuel injection pump for internal combustion engines having a piston which is adjustable counter to a restoring force by a fluid from a supply pump. The generated restoring force is in proportion to engine rpm for adjusting injection onset and having rpm-proportional control of the fluid pressure via a pressure control valve. A displaceable control piston is provided between a pressure chamber and a restoring chamber counter to a restoring force and arranged to determine a spill cross section. A throttle connection is also provided between the pressure chamber and the restoring chamber. A discharge control device is connected to the restoring chamber which also includes a valve that functions in accordance with engine characteristics.

In a known fuel injection pump of this kind, a pressure valve is disposed in the outflow channel, the valve being controllable via a thermostatic valve. The opening of this valve is effected in accordance with temperature. The variation of the normal adjustment characteristic of the injection adjuster effected by this supplementary control accordingly acts over the entire rpm range, which is associated with an impairment of the exhaust gas quality as well as of the efficiency of the engine.

OBJECT AND SUMMARY OF THE INVENTION

The fuel injection pump according to the invention having a control valve which is actuated by the pressure determined by a pressure control valve and a control spring. The initial stress of this spring is variable in accordance with engine characteristics. The present invention has the advantage over the prior art that with the simplest means it is possible for the variation, which is dependent on engine characteristics, of the normal course of injection onset to be prevented in the higher rpm range. In addition, the manner of the adjustment, which is dependent on engine characteristics, is made particularly simple.

The invention will be better understood and further objects and advantages thereof will become more apparent from the ensuing detailed description of a preferred embodiment taken in conjunction with the drawings.

DESCRIPTION OF A PREFERRED EMBODIMENT

Figure 1:
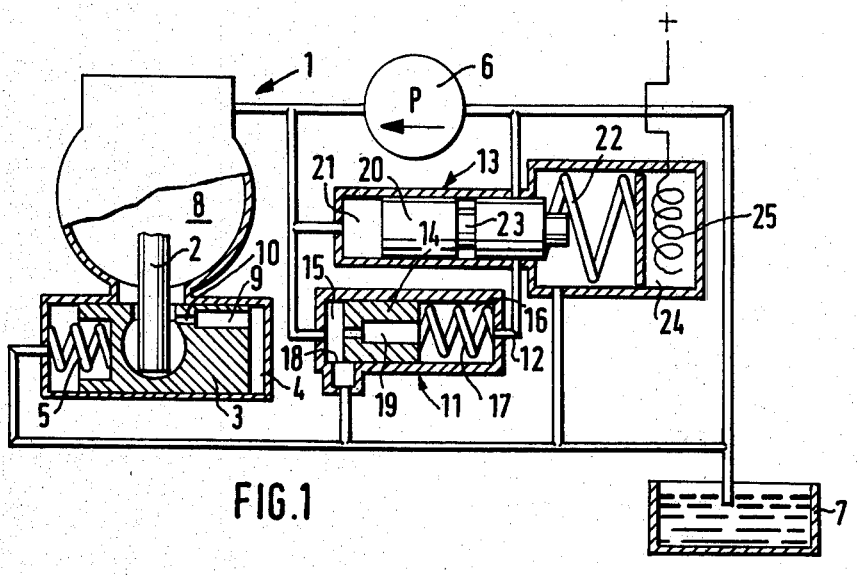
FIG. 1 is a cross-sectional view of a structure illustrating the principle of the invention.

Turning now to the drawing an adjusting system 3 is adapted to engage the cam drive of a fuel injection pump 1 via a pin 2 for the adjustment of the instant of injection onset. The adjusting system 3 is displaced counter to a restoring spring 5 by means of pressure fluid located in a work chamber 4 and the more the piston is displaced in a direction of the spring 5, the more the instant of injection is displaced toward "early" relative to top dead center of the engine piston. A supply pump 6 aspirates fuel from a fuel container 7 and delivers it into a suction chamber 8 of the injection pump 1, from which (not shown in further detail) the actual fuel injection pump is supplied with fuel and which communicates with the work chamber via the bore 9 in the adjusting system 3. This bore 9 has a throttle restrictor 10. The supply pressure of the supply pump 6 and thus the pressure in the suction chamber 8 are controlled in accordance with rpm via a pressure control valve 11, the pressure normally increasing proportionally with increasing rpm. This rpm-dependent pressure also prevails in the work chamber 4, so that increasing rpm and thus increasing pressure the injection adjusting piston 3 is displaced toward "early" (toward the left).

Figure 2:
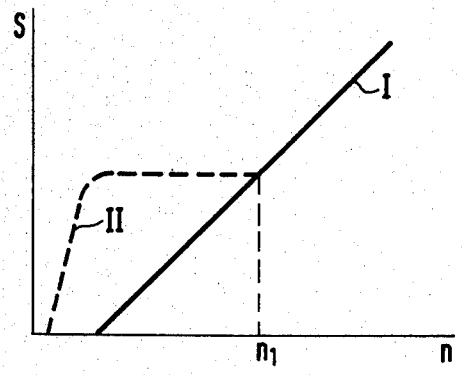
FIG.2 is a functional diagram of the same.

In FIG. 2, a diagram is given in which the stroke s (ordinate) of the adjusting system is plotted over the rpm n (abscissa). The line I represents the adjustment of injection onset; that is, the stroke s and thus the adjustment toward "early" increases linearly with the rpm n. For cold starting and to meet other possible requirements made by engine manufacturers it is desirable for the injection onset to be adjusted toward "early" up to a predetermined rpm n, by way of example, in accordance with curve II, in order then to again obtain the course of injection represented by line I.

In order to obtain this, a slide valve 13 is disposed according to the invention in the discharge line 12 of the pressure control valve 11 which is known per se. The pressure control valve 11 has a pressure control piston 14, which on one end in a pressure chamber 15 is exposed to the fuel supplied by the supply pump 6 and which is engaged on the other end in the restoring chamber 16 by a restoring spring 17. The control piston 14, in its balanced position, determines a spill cross section 18. A throttle connection 19 is provided in the control system 14 which connects the pressure chamber 15 and the restoring chamber 16 with one another. Depending upon how extensive the restriction is which is caused in the restoring chamber 16, this balance is varied and the control piston is displaced accordingly in the direction of a reduction of the spill cross section 18.

The valve 13 has a control slide 20, which is displaceable in a chamber 21 counter to the force of the control spring 22 by means of the pressure determined by the supply quantity of supply pump 6 and the spill cross section 18. The control slide 20 has an annular groove 23, which cooperates with the discharge channel 12. The control spring 22 is supported on the side remote from the slide 20 on an adjusting member 24 which is displaceable by way of example by a thermostatic element 25 for the purpose of varying the initial stress of the spring 22.

In FIG. 1, the apparatus is illustrated directly after starting. The slide 20 still blocks the discharge channel 12, but it has displaced the control piston 14 counter to spring 17 to such an extent that a certain quantity of fuel can flow out by way of the spill cross section 18. However, because the discharge channel 12 of the restoring channel 16 is blocked, the control piston 14 is very rapidly displaced into a position in which the spill cross section 18 is also reduced to 0. The pressure increase in chamber 21 thus effected causes a displacement of the slide 20 into a position in which the discharge channel 12 is at least partially open, so that the control piston 14, slightly yielding, adjusts itself to a high work pressure, that is, a small spill cross section 18. The injection adjusting piston 3 is displaced toward "early" in accordance with the broken line II in FIG. 2. Now, as soon as the thermal element 25 causes a reduction in the initial stress of a spring 22 (for instance, as a result of the warming up of the internal combustion engine), the throttle cross section at the annular groove 23 is enlarged toward the discharge channel 12 and accordingly causes a reduction in the adjustment toward "early". However, as soon as the rpm n1 has been obtained (generally above the idling rpm), the force of the spring 22 is overcome in every case by the pressure in the chamber 21, so that the discharge channel 12 always remains open, and the pressure control valve 11 functions in accordance with the line I.

Instead of a thermal element 25, some other control element displacing the stop 24 can also be used.

The foregoing relates to a preferred exemplary embodiment of the invention, it being understood that other embodiments and variants thereof are possible within the spirit and scope of the invention, the latter being defined by the appended claims.

What is claimed and desired to be secured by Letters Patent of the United States is:

1. A fuel injection system for internal combustion engines having:

a fuel injection pump;

a supply pump which is driven synchronously to the engine speed and supplies fluid in the system;

a pressure relief means;

an adjustable piston connected to the pressure side of the supply pump to be biased in a first direction;

a restoring means which generates a restoring force and is connected to the adjustable piston such that the restoring force biases the adjustable piston in a second direction, wherein the adjustable piston is connected to the fuel injection pump to regulate fuel injection onset;

a pressure control valve connected to the pressure side of the supply pump to control pressure of the fluid according to engine rpm;

a control piston having a pressure chamber connected to the supply pump to bias the control piston in a first direction; a restoring chamber which provides a restoring force that biases the control piston in a second direction, a throttle connection in the control piston which connects the pressure chamber and the restoring chamber, a discharge means connected to the restoring chamber to control fluid discharge from the restoring chamber to said pressure relief means wherein the control piston is arranged to define a spill cross section between the pressure chamber and said pressure relief means and is arranged to control the spill cross-section;

said pressure relief means including a valve member interposed in said discharge means said valve member being exposed the pressure of the fluid controlled by the pressure control valve;

a control spring biasing said valve member against said controlled pressure;

a means to detect at least one engine characteristic connected to vary initial stress of the control spring according to the at least one engine characteristic such that said valve member functions according to the at least one engine characteristic.

2. A fuel injection system as defined in claim 1 wherein the valve member is a slide valve comprising a cylinder and a slide mounted in the cylinder, wherein the slide has one end face exposed to the pressure of the supply fluid and a groove is recessed in the slide, wherein the cylinder has a bore that is fluidly connected said discharge means and to the groove according to slide positions.

3. A fuel injection system as defined in claim 2, including a stop to which an end of the control spring is secured, remote from the slide, wherein the stop is connected to the means to detect at least one engine characteristic to be displaced according to the at least one engine characteristic.

4. A fuel injection system as defined in claim 3, wherein the slide valve is connected to be biased by the pressure of the supply fluid to fluidly open the groove to the bore when the engine operates above a predetermined rpm above idling rpm.

* * * * *